United States Patent [19]

Fitzgibbon, Jr.

[11] Patent Number: 5,000,261

[45] Date of Patent: Mar. 19, 1991

[54] INFLATABLE DEVICES FOR SUSPENDING EXPLOSIVES IN BOREHOLES

[76] Inventor: Daniel F. Fitzgibbon, Jr., P.O. Box 110, Finchville, Ky. 40022

[21] Appl. No.: 469,384

[22] Filed: Jan. 24, 1990

[51] Int. Cl.[5] ..... E21B 33/127

[52] U.S. Cl. ..... 166/187; 166/386; 102/333

[58] Field of Search ..... 166/187, 179, 192, 386; 102/304, 311, 312, 313, 333; 138/93; 277/34

[56] References Cited

U.S. PATENT DOCUMENTS

| | | | |
|---|---|---|---|
| 3,130,787 | 4/1964 | Mason | 166/192 |
| 3,276,481 | 10/1966 | McNulty | 138/93 |
| 3,357,193 | 12/1967 | Fitzgibbon, Jr. | 102/333 |
| 3,493,045 | 2/1970 | Bassini | 166/187 |
| 3,806,025 | 4/1974 | Marshall | 102/333 |
| 3,995,694 | 12/1976 | Freiburger | 166/285 |
| 4,660,644 | 4/1987 | Egnor | 102/333 |

*Primary Examiner*—Ramon S. Britts
*Assistant Examiner*—Terry Lee Melius
*Attorney, Agent, or Firm*—Kenneth E. Darnell

[57] ABSTRACT

Inflatable devices configured for supporting explosives particularly in vertical boreholes of widely varying diameter. The inflatable devices of the invention can be used in the pre-splitting and blast removal of earth formations by suspending explosives in both pre-splitting and production boreholes. Plugging of such boreholes is accomplished through the use of the present inflatable devices which are formed of flexible polymeric material and which stretch to seal boreholes and to exert forces against borehole walls sufficient to support heavy columns of explosives and/or stemming at desirable borehole locations. The present inflatable devices are restrained into a pre-splitting configuration and inflated to a configuration capable of supporting explosives and/or stemming within a borehole.

17 Claims, 2 Drawing Sheets

INFLATABLE DEVICES FOR SUSPENDING EXPLOSIVES IN BOREHOLES

Cross Reference to Related Applications

The present application relates to U.S. patent applications Ser. No. 166,542 of Mar. 10, 1988 and Ser. No. 276,651 of Nov. 28, 1988, both entitled "Methods and Apparatus for Field Blasting of Earth Formations using Inflatable Devices for Suspending Explosives in Boreholes" and having the same inventive entity as the present application, the disclosures of both applications being incorporated hereinto by reference.

BACKGROUND OF THE INVENTION

I. Field of the Invention

The invention relates generally to the shattering of earth formations and earth formation removal by the detonation of explosives within boreholes formed in the earth formations. The invention specifically relates to inflatable devices used to support explosives and/or stemming within a borehole and which are configured to be restrained into a first configuration easily insertable into a borehole and subsequently inflatable to expand into a configuration capable of supporting explosives and/or stemming within the borehole.

II. Description of the Prior Art

A practice known as pre-splitting has previously been practiced in mining and earth removal operations. Pre-splitting is used to shatter earth formations in a controllable manner so that subsequent earth removal operations become more efficient. In typical pre-splitting operations, a number of spaced boreholes are drilled in an earth formation which is to be shattered. Explosives are disposed within the boreholes and detonated to shatter the formation. The pre-splitting operation facilitates the removal of overburden by means of subsequent "production" blasting to expose seams of material which is to be mined Earth removal methods used for other purposes also have employed pre-splitting techniques. In both pre-splitting and production blasting, it is desirable to be able to "plug" boreholes with devices capable of supporting heavy columns of explosives and/or stemming materials. Methods and apparatus capable of such use are disclosed in copending U.S. patent applications Ser. No. 166,542 of Mar. 10, 1988 and Ser. No. 276,651 of Nov. 28, 1988, both entitled "Methods and Apparatus for Field Blasting of Earth Formations using Inflatable Devices for Suspending Explosives in Boreholes", the disclosures of both applications being incorporated hereinto by reference. These patent applications describe inflatable devices and methods for their use. The inflatable devices thus disclosed are of substantial utility in the art since they are of simple and inexpensive construction yet are capable of supporting explosives and/or stemming in boreholes of even large diameter.

The art is improved by the provision of the methods and apparatus herein disclosed which provide inexpensive plugging devices which can be rapidly and conveniently used in field blasting operations. The relatively inexpensive nature of the present devices allow the practice of a variety of pre-splitting and blasting methods at a minimum of expense. The present devices and methods thus constitute a significant and substantial advance in the art.

SUMMARY OF THE INVENTION

The invention provides particular embodiments of inflatable devices disposable within boreholes formed in earth formations, the boreholes with which the embodiments of the invention are of particular use being vertical or substantially vertical in orientation with the inflatable devices of the invention acting to suspend explosives and/or stemming materials within said boreholes to allow practice of methods for shattering the earth formations to effect pre-splitting or for causing earth removal from the formation inter alia. Inflatable devices of the invention are positioned within boreholes in a deflated condition and are restrained by tie structure to a deflated, compact condition and are subsequently inflated at the desired location within the borehole to seal or "plug" the hole for support of explosive columns and/or stemming columns The devices of the invention can be formed of various flexible polymeric materials including polyvinylchlorides, low density polyethylenes and polyurethane films in selected thicknesses as examples. The flexible vinyls and polyethylenes exhibit desirable cost properties but are less desirable in that they lack low temperature flexure and tensile strength and are furthermore susceptible to abrasion and tearing than are aromatic polyether polyurethanes and polyester-based polyurethane films. The polyurethane materials, while more expensive, are more readily fabricated and endure the conditions of use more acceptably than competing materials. Primarily, the selected material forming the present inflatable devices must have the capability to stretch to a degree sufficient to cause the device to be firm within the borehole and yet resist continued stretching, particularly in directions along the longitudinal axis of the borehole which would cause the device to fail. The present inflatable devices can be shaped in various conformations and are provided with valves which allow inflation of the devices through hoses connected to the valves while the devices are in place within the boreholes. Valves such as tire valves, oral valves, needle valves and the like are useful. However, valves such as needle valves are self-sealing and are readily connected to and disconnected from an airline such that the device can be lowered down into a borehole, inflated and then readily released from the air line. Valves such as oral valves typically require a protective flap when used with the devices of the invention.

The devices of the invention are restrained before being lowered into a borehole by means of a tie and preferably a flexible tie such as a rubber band. The tie conforms the deflated inflatable device into a compact condition and thereby allows ready placement of the deflated device into a desired position within the borehole. The deflated device is conveniently tied with a valve element located at an end which is disposed uppermost within the borehole and thus readily joins to an airline which supports the device at a desired location within the borehole and also provides a conduit for inflating fluid. On inflation through the airline, the device inflates against the restraining force of the tie and assumes a sealing or "plugging" position within the borehole at the desired location.

The inflatable devices of the invention can be formed in differing sizes to accommodate boreholes of differing diameter. The disc-like conformations of the invention are preferred and are preferably sized to be used in boreholes of 3" diameters and greater such as have conventionally been used in pre-splitting and production blasting. A convenient material used for forming the devices so described is polyurethane film with thicknesses of between 12 and 40 mils and preferably between 12 and 22 mils.

The inflatable devices of the invention can be used in the practice of a variety of pre-splitting and earth removal or blasting methods to support explosives and/or stemming. The devices act to maximize the efficiency of the explosive used in both pre-splitting and production blasting. In many situations, the inflatable devices of the invention are of substantial utility when used to support a stemming column at or near the top of the borehole, the stemming column acting to contain energy on detonation of explosives within the bore-hole, thereby gaining maximum benefit from the energy of the explosion. A particular benefit of the present devices is the ability to drill pre-splitting holes with the same drilling equipment used to drill production holes. In such a situation, the same drill and association equipment is used to drill production holes, typically 9" holes, as is used to drill the pre-splitting holes. Substantial operational savings acrue from the ability to use the same drilling equipment since separate drills are not necessary for drilling the conventionally larger production holes and the conventionally smaller pre-splitting holes. The present inflatable devices allow the use of larger diameter pre-splitting holes since said devices are capable of supporting heavier columns, particularly stemming columns, occasioned by the larger diameter holes. The present devices can be used in production holes even though separate pre-splitting methods are not employed.

Accordingly, it is an object of the present invention to provide inflatable devices useful in pre-splitting and production blasting of earth formations, the inflatable devices being formed into a compact configuration by means of a tie and particularly a resilient tie such as a rubber band in order to facilitate placement of a device within a borehole.

Further objects and advantages of the invention will become more readily apparent in light of the following detailed description of the preferred embodiments.

DESCRIPTION OF THE PREFERRED EMBODIMENTS

Figure 1:
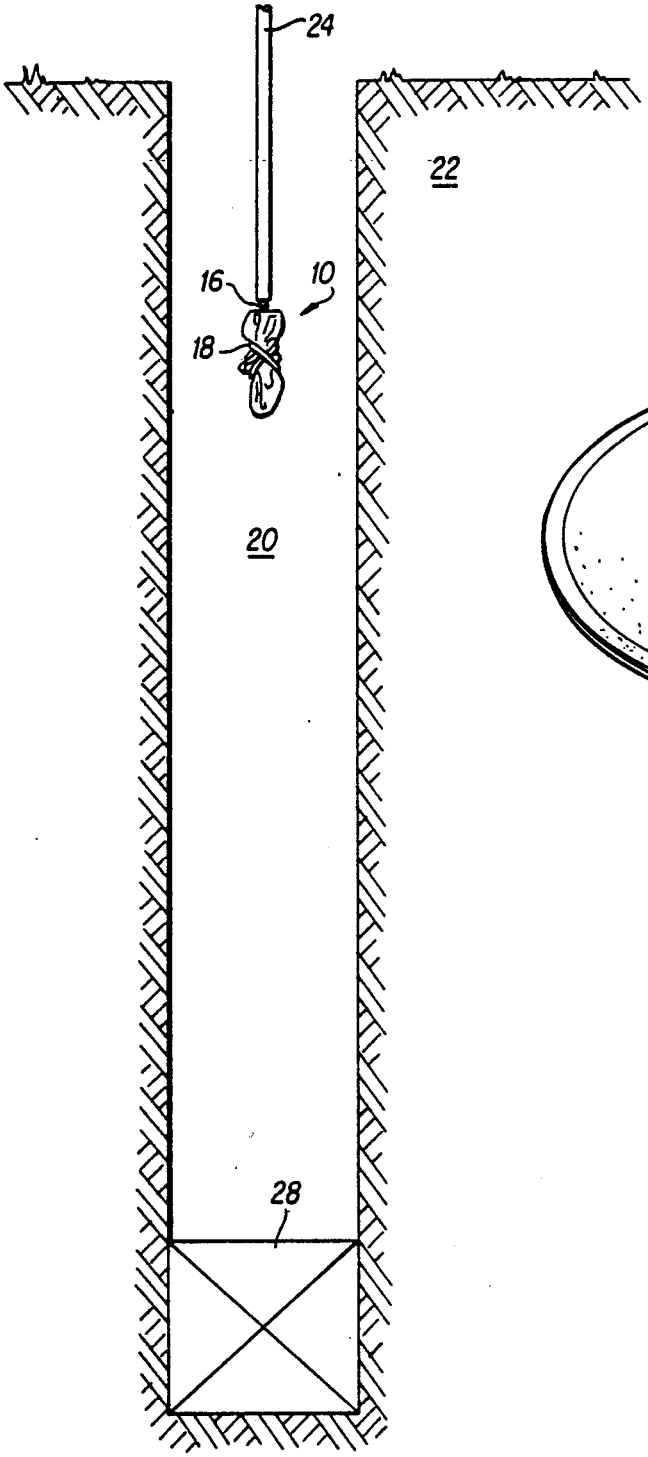
FIG. 1 is an idealized elevational view in partial section of an inflatable device configured into a compact conformation and disposed within a borehole at a desired location within said borehole, explosive charge being disposed in the bottom of the borehole.
Figure 2:
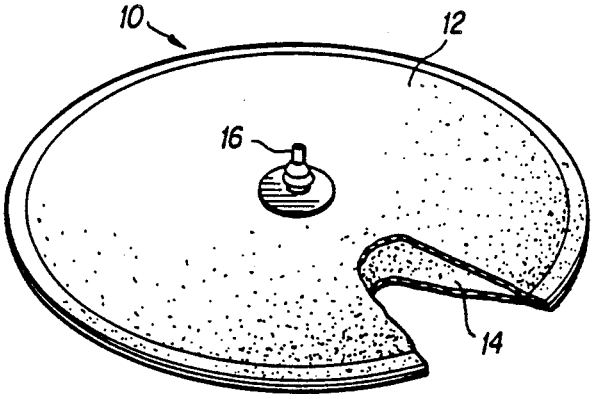
FIG. 2 is an idealized perspective view of an inflatable device of a particular conformation useful in the practice of the invention, the device being shown in a deflated configuration prior to being configured into a compact conformation by means of a tie structure according to the invention.

Referring now to the drawings and particularly to FIGS. 1 through 4, a preferred inflatable device configured according to one embodiment of the invention is seen at 10 to be disc-like in conformation when deflated as best shown in FIG. 2. The inflatable device 10 is formed of upper and lower discs 12 and 14 which are formed of one of the materials disclosed herein. The discs 12 and 14 are sealed to each other about their respective outer peripheries such as by heat sealing according to practices which are conventional in the art. The upper disc 12 has a valve 16. If valve 16 is chosen to be a needle valve, it is not necessary to protect said valve 16 from contact with obstructions which are to be found in a borehole.

The inflatable device 10 can be pulled into an elongated conformation by grasping the valve 16 and that portion of the lower disc 14 which is immediately surmounted by the valve 16 and elongating said device 10. In this conformation the device 10 can then be mechanically held in the resulting compact conformation by means of a mechanical tie 18 such as a rubber band. While the tie may be other than a resilient article such as a rubber band, a resilient tie is preferred since the tie can expand with the inflatable device on inflation thereof. Otherwise, the tie 18 must be of a nature such that the tie releases from the device 10 on inflation of said device. The inflatable device 10 held in this compact configuration by the tie 18 is best seen in FIG. 3.

Figure 3:
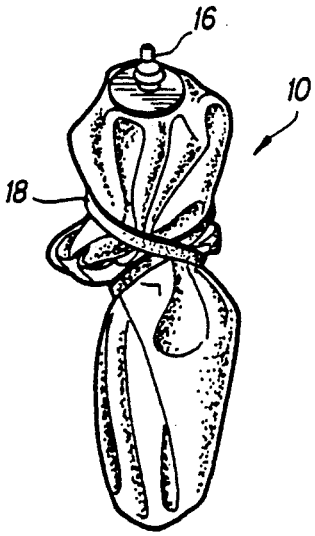
FIG. 3 is an idealized perspective view of the inflatable device of FIG. 2 once configured into a compact configuration by means of a mechanical tie structure.

Referring now to FIG. 1, the inflatable device 10 having the conformation shown in FIG. 3 is lowered into a borehole 20 which has been drilled into substrate 22. The device 10 is lowered into the borehole 20 by means of airline 24 which fits over the valve 16. The tied device 10 may therefore be lowered to any desired position within the borehole 20 by means of the airline 24. Once positioned, the inflatable device 10 is inflated through the airline 24 and valve 16, walls of the inflatable device expanding to contact walls of the borehole 20. The tie 18 may break loose from the inflatable device 10 on inflation of said device or may expand with the said device and be retained on the device even after the device 10 has reached full inflation within the borehole 20 as is shown in FIG. 4.

Figure 4:
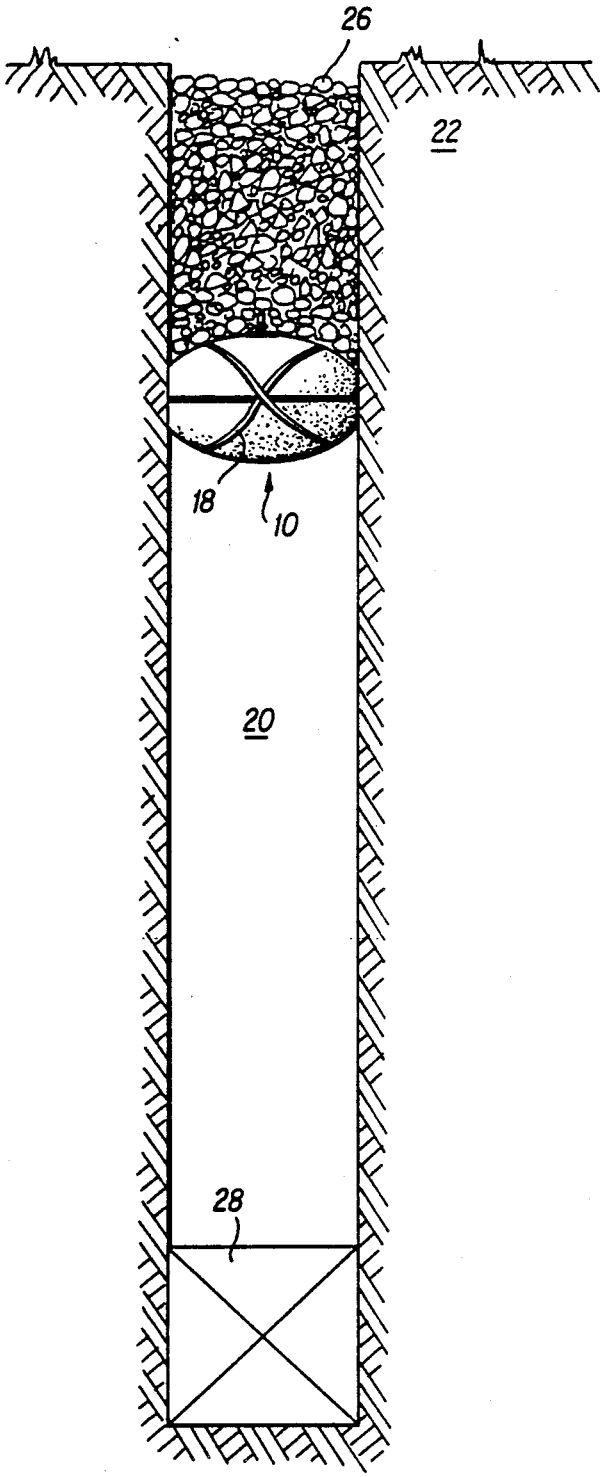
FIG. 4 is an idealized elevational view in partial section of the compact device of FIGS. 1 and 3 shown in a borehole after inflation of the device.

As seen in FIG. 4, the inflatable device 10, once positioned and inflated, is primarily used to support columns of explosives or columns of stemming materials such as the materials 26 shown in FIG. 4. An explosive charge 28 is disposed within lower portions of the borehole 20, the charge typically comprising ammonium nitrate/fuel oil (ANFO). The various uses of the inflatable device 10 are more fully detailed in related patent application Ser. No. 166,542 of Mar. 10, 1988, as referred to herein. The inflatable device 10 of FIGS. 1 through 4 can be used in the various situations described in the aforesaid patent application.

Figure 5:
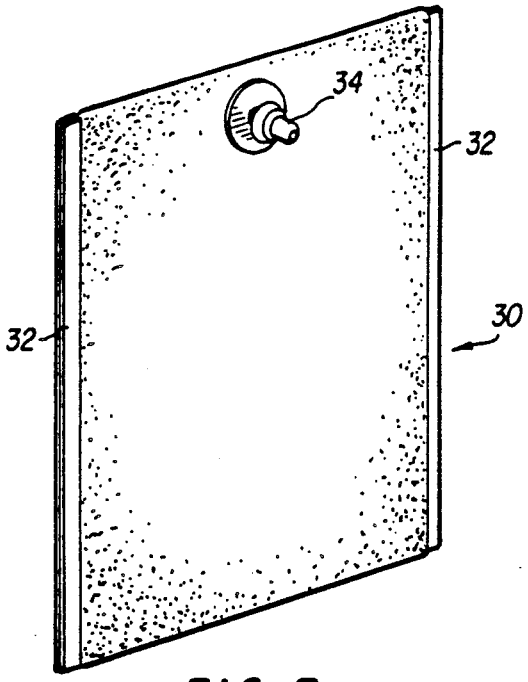
FIG. 5 is an idealized perspective view of a substantially rectangular inflatable device in a deflated condition prior to being configured into a compact conformation for disposition within a borehole; and, FIG. 6 is an idealized perspective view of the inflatable device of FIG. 5 after said device is configured into a compact conformation through use of a mechanical tie structure.
Figure 6:
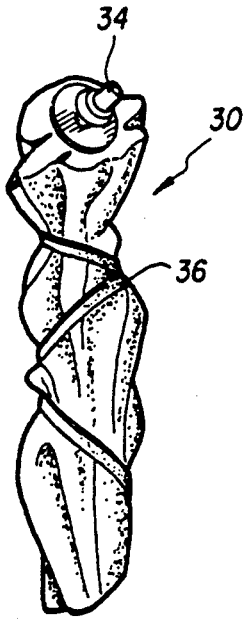

Referring now to FIGS. 5 and 6, an inflatable device 30 structured according to another embodiment of the invention is seen to be formed from a flexible "tube" of polymeric material such at only open ends or sealed together at 32 to form said device 30. The inflatable device 30 is provided with a needle valve 34 through which the device 30 is inflated in a manner substantially identical to that described above relative to the inflatable device 10. The inflatable device 30 is folded or crumpled in a direction substantially perpendicular to its longitudinal axis in order to cause the device 30 to assume a more compact conformation to facilitate insertion of said device into a borehole. A mechanical tie 36 such as a rubber band is utilized in a manner essentially identical to that described above relative to the tying of the inflatable device 10 in order to hold said folded or crumpled inflatable device 10 in this compact conformation. It is to be understood that substantially all of the inflatable devices described in the aforesaid copending U.S. patent applications can be similarly folded, or crumpled and then tied with a rubber band or similar mechanical tie in order to facilitate insertion of the devices into a borehole. In these several embodiments, the valve is preferably disposed at a location of the compacted device which is substantially "on top of" the device in order that an airline can conveniently be attached thereto and the device lowered in a proper orientation into a borehole.

The characteristics of the materials used to form the inflatable devices 10 are fully enumerated in the aforesaid U.S. patent applications which are incorporated hereinto by reference. Further, the various methods described in the aforesaid U.S. patent applications can be practiced through use of the inflatable devices described herein relative to those methods wherein such a device is lowered into a borehole and as will be apparent to one of ordinary skill in the art.

While the invention has been described relative to particular embodiments of the present inflatable devices and in light of particular methodology, it is to be understood that the invention can be practiced other than as explicitly described herein, the invention being limited only by the recitation of the appended claims.

What is claimed is:

1. A device capable of being inflated in a borehole formed vertically or essentially vertically in the earth prior to initiation of blasting within the borehole, the device acting to suspend a column of stemming material or explosive material within the borehole, comprising:

a flexible body member capable of inflation within the borehole;

valve means carried by the body member for connection to a source of inflating fluid and through which the body member is filled with said fluid to expand the body member into engagement with walls of the borehole; and, resilient means disposed about the body member for exerting a restraining force on said body member to cause said body member to assume a compact configuration thereby to facilitate insertion of the device into the borehole and for releasing the body member on inflation to allow the body member to extend into contact with walls of the borehole and to transfer pressure from said fluid to the walls of the borehole, the pressure being adequate to provide an essentially vertical force component direct against the stemming material or explosive material to support said material at a desired location within the borehole, the resilient means expanding with the flexible body member.

2. The device of claim 1 wherein the resilient means comprise a loop of rubber.

3. The device of claim 1 wherein the body member is formed of opposed planar sheets of a flexible polymeric film sealed together at perimetric edges.

4. The device of claim 3 wherein the planar sheets are circular.

5. The device of claim 3 wherein the planar sheets are rectangular.

6. The device of claim 3 wherein the sheets are formed of a polyester-based polyurethane film.

7. The device of claim 1 wherein the valve means comprise a needle valve.

8. The device of claim 4 wherein the circular planar sheets are deformed along an axis taken through the centers of the sheets to an elongated conformation, the resilient means being disposed about the body member thus elongated to hold said body member into the elongated, compact conformation so formed.

9. The device of claim 5 wherein the rectangular planar sheets are folded in a direction perpendicular to the longitudinal axes of the sheets, the resilient means being disposed about the body member thus folded to hold said body member into the folded, compact conformation so formed.

10. A device capable of being inflated in a borehole formed vertically or essentially vertically in the earth prior to initiation of blasting within the borehole, the device acting to suspend a column of stemming material or explosive material within the borehole, comprising:

a flexible body member capable of inflation within the borehole;

means carried by the body member for inflating said body member with fluid to expand the body member into engagement with walls of the borehole; and, resilient means disposed about the body member for exerting a restraining force on said body member to cause said body member to assume a compact configuration thereby to facilitate insertion of the device into the borehole and for releasing the body member on inflation by the inflating means to allow the body member to extend into contact with walls of the borehole and to transfer pressure from said fluid to the walls of the borehole, the pressure being adequate to provide an essentially vertical force component directed against the stemming material or explosive material to support said material at a desired location within the borehole, the resilient means expanding with the flexible body member.

11. The device of claim 10 wherein the resilient means comprise a loop of rubber.

12. The device of claim 10 wherein the body member is formed of opposed planar sheets of a flexible polymeric film sealed together at perimetric edges.

13. The device of claim 12 wherein the planar sheets are circular.

14. The device of claim 12 wherein the planar sheets are rectangular.

15. The device of claim 12 wherein the sheets are formed of a polyester-based polyurethane film.

16. The device of claim 13 wherein the circular planar sheets are deformed along an axis taken through the centers of the sheets to an elongated conformation, the resilient means being disposed about the body member thus elongated to hold said body member into the elongated, compact configuration so formed.

17. The device of claim 14 wherein the rectangular planar sheets are folded in a direction perpendicular to the longitudinal axes of the sheets, the resilient means being disposed about the body member thus folded to hold said body member into the folding, compact configurations so formed.

* * * * *